US008979605B2

(12) United States Patent
Senn

(10) Patent No.: US 8,979,605 B2
(45) Date of Patent: Mar. 17, 2015

(54) PERSONAL FLOATATION DEVICE SLEEVE

(71) Applicant: Richard Bernard Senn, San Antonio, TX (US)

(72) Inventor: Richard Bernard Senn, San Antonio, TX (US)

( * ) Notice: Subject to any disclaimer, the term of this patent is extended or adjusted under 35 U.S.C. 154(b) by 24 days.

(21) Appl. No.: 13/941,352

(22) Filed: Jul. 12, 2013

(65) Prior Publication Data

US 2013/0295804 A1 Nov. 7, 2013

Related U.S. Application Data

(63) Continuation-in-part of application No. 13/052,185, filed on Mar. 21, 2011, now Pat. No. 8,790,147.

(51) Int. Cl.

| | |
|---|---|
| ***B63C 9/15*** | (2006.01) |
| ***B63C 9/125*** | (2006.01) |
| ***A45F 5/00*** | (2006.01) |

(52) U.S. Cl.

CPC . *B63C 9/155* (2013.01); *A45F 5/00* (2013.01); *A45F 2005/008* (2013.01)

USPC ..... 441/92

(58) Field of Classification Search

USPC ..... 441/80, 87, 88, 90–97, 122, 123

See application file for complete search history.

(56) References Cited

U.S. PATENT DOCUMENTS

| | | | | | |
|---|---|---|---|---|---|
| 149,513 | A * | 4/1874 | Ormsbee | 441/122 |
| 1,611,427 | A * | 12/1926 | Evans | 441/122 |
| 3,820,179 | A * | 6/1974 | Maertin | 441/122 |
| 4,671,507 | A * | 6/1987 | Huttner | 482/55 |
| 5,190,489 | A * | 3/1993 | Yeung | 441/122 |
| 5,393,254 | A * | 2/1995 | Ducheshe | 441/118 |
| 6,036,562 | A * | 3/2000 | Brown | 441/108 |
| 7,267,509 | B1 * | 9/2007 | Jackson, III | 405/186 |
| 7,347,757 | B1 * | 3/2008 | Lanthier | 441/122 |
| 7,918,701 | B2 * | 4/2011 | Spinoza | 441/108 |
| 2004/0033740 | A1 * | 2/2004 | Jones | 441/122 |

OTHER PUBLICATIONS www.myswimit.com, The Swim It, Jan. 2012 (2 pages).

* cited by examiner

*Primary Examiner* — Daniel V Venne

(74) *Attorney, Agent, or Firm* — Gunn, Lee & Cave, P.C.

(57) ABSTRACT

The personal floatation device (PFD) sleeve presented in this application comprises a sleeve in the form of a strip that can be worn on a swimmer's appendage including leg, calf and arm. The PFD sleeve may be made of a flexible, water resistant material. The PFD sleeve comprises a single compartment wherein a deflated PFD with $CO_2$ cartridge is stored during swimming, and a first and a second connection panel whose major function is to wrap around the appendage of a swimmer using the fastening means on their surfaces. The present invention provides a PFD that is simple, reliable, light-weight, compact and can be inflated and deployed quickly during an emergency to support a swimmer floating on the water but does not affect the swimmer's mobility before it is deployed.

16 Claims, 7 Drawing Sheets

PERSONAL FLOATATION DEVICE SLEEVE

CROSS REFERENCE TO RELATED APPLICATIONS

This continuation-in-part patent application claims the benefit U.S. patent application Ser. No. 13/052,185, filed Mar. 21, 2011. The previous patent application identified in the foregoing sentence is incorporated herein by reference in its entirety to provide continuity of disclosure.

STATEMENT REGARDING FEDERALLY SPONSORED RESEARCH OR DEVELOPMENT

Not applicable

BACKGROUND OF THE INVENTION

1. Technical Field

The present invention relates generally to personal floatation devices and, more particularly to a personal floatation device that is deflated and can be worn on a user's appendage while swimming without affecting user's mobility and can be quickly inflated and deployed when the need for use or an emergency arises.

2. Description of the Related Art

U.S. patent application Ser. No. 13/052,185 offers a personal floatation device (PFD) sleeve that can be worn around a user's appendage and used in emergency situations while in water. The PFD sleeve attaches to the user's appendage using one or more first and second connection panels connected to opposing sides of a compartment. Preferably, the connection panels are connected to the compartment via one or more strips extending along a bottom surface of the compartment, and, the compartment is attached to the strips by sewing or the like. The compartment has an opening between a first top wall and a second top wall and a deflated PFD may be inserted into an interior of the compartment through the opening.

The PFD inserted into the compartment has a gas cartridge releasing mechanism. The gas cartridge releasing mechanism causes a cartridge containing compressed gas to inflate the PFD. A cord operatively coupled the gas cartridge releasing mechanism extends out of the opening of the compartment and is pulled to activate the mechanism. Once activated, the mechanism punctures the compressed gas cartridge, which causes the compressed gas therein to rapidly exit the cartridge and enter the PFD to inflate it. The rapidly expanding volume of the PFD upon inflation causes the PFD to exit the compartment through the opening. The PFD is tethered to the compartment and the buoyancy of the PFD pulls the user to safety.

With the cord extending out of the opening and dangling from the PFD sleeve, there is a risk that it may be inadvertently pulled and the PFD inadvertently deployed. That risk is exacerbated when the density of swimmers around a user of the PFD sleeve is elevated. For example, starting the swimming portion of a triathlon presents a situation where the risk of inadvertent PFD deployment is increased. Other examples may be swimming at a crowded beach or the like. Accordingly, a need exists to secure the cord from being accidentally pulled.

Additionally, it has been found that the compartment of the PFD sleeve may shrink and stretch depending on whether it is wet or dry. The stretching or the shrinking of the compartment may affect the performance of the PFD sleeve and dissuade people from wearing it. For example, increased drag of the PFD sleeve through the water can occur if the compartment loosely surrounds the PFD instead of being taut around it. In the competitive triathlon environment referred to above, for example, the notion of increased drag and slower race times dissuades those competitors from using the PFD sleeve. Therefore, a need exists for a compartment which may still be tautly closed around the PFD even when the compartment stretches.

BRIEF SUMMARY OF THE INVENTION

The embodiment of the PFD sleeve disclosed herein addresses the aforementioned problems. While having many of the same features as the embodiment disclosed in application Ser. No. 13/052,185, the present embodiment also has a retaining strip attached to the compartment to secure the cord. The retaining strip has two attachment points to the compartment and extends over an outer surface of the second top wall. The cord, or preferably a handle attached to the cord, is positioned between the retaining strip and the compartment to secure the cord to the compartment. Thus, the retaining strip extends over the handle or over the cord between its attachment points.

The retaining strip may be permanently or detachably connected to the compartment. If detachably connected, one of its attachment points has a fastening means which allows the retaining strips to be pulled away from the compartment at that point. A user may pull the retaining strip away from the compartment to access the handle. In the preferred embodiment, the fastening means is Velcro® or some other hook-and-loop fastener, and, the retaining strip has a first component of the hook-and-loop fastener sewn or otherwise affixed to it while the second top wall of the compartment has a second component of the hook-and-loop fastener sewn or otherwise affixed to it.

A first top wall of the compartment preferably overlaps the second top wall of the compartment, thereby creating an opening for the PFD. A fastening means between the first and second top walls closes the opening. Preferably, the fastening means is Velcro® or some other hook-and-loop fastener, and, the overlapping portion of the first top wall has a first component of the hook-and-loop fastener sewn or otherwise affixed to it while a second component of the hook-and-loop fastener is sewn or otherwise affixed to the second top wall. The second component has a larger surface area than the first component so that the first top wall can be pulled taut over the PFD even when the compartment is wet and stretchable.

Preferably, the second component of the hook-and-loop fastener between the first and second top walls is an integral piece with the second component of the hook-and-loop fastener between the retaining strip and the second top wall. In other words, both second components are along a single piece of Velcro® (or other hook-and-loop fastener) on the second top wall. The single integral piece allows for more efficient manufacturing of the device while meeting the above-identified needs.

DETAILED DESCRIPTION OF THE INVENTION

Figure 1:
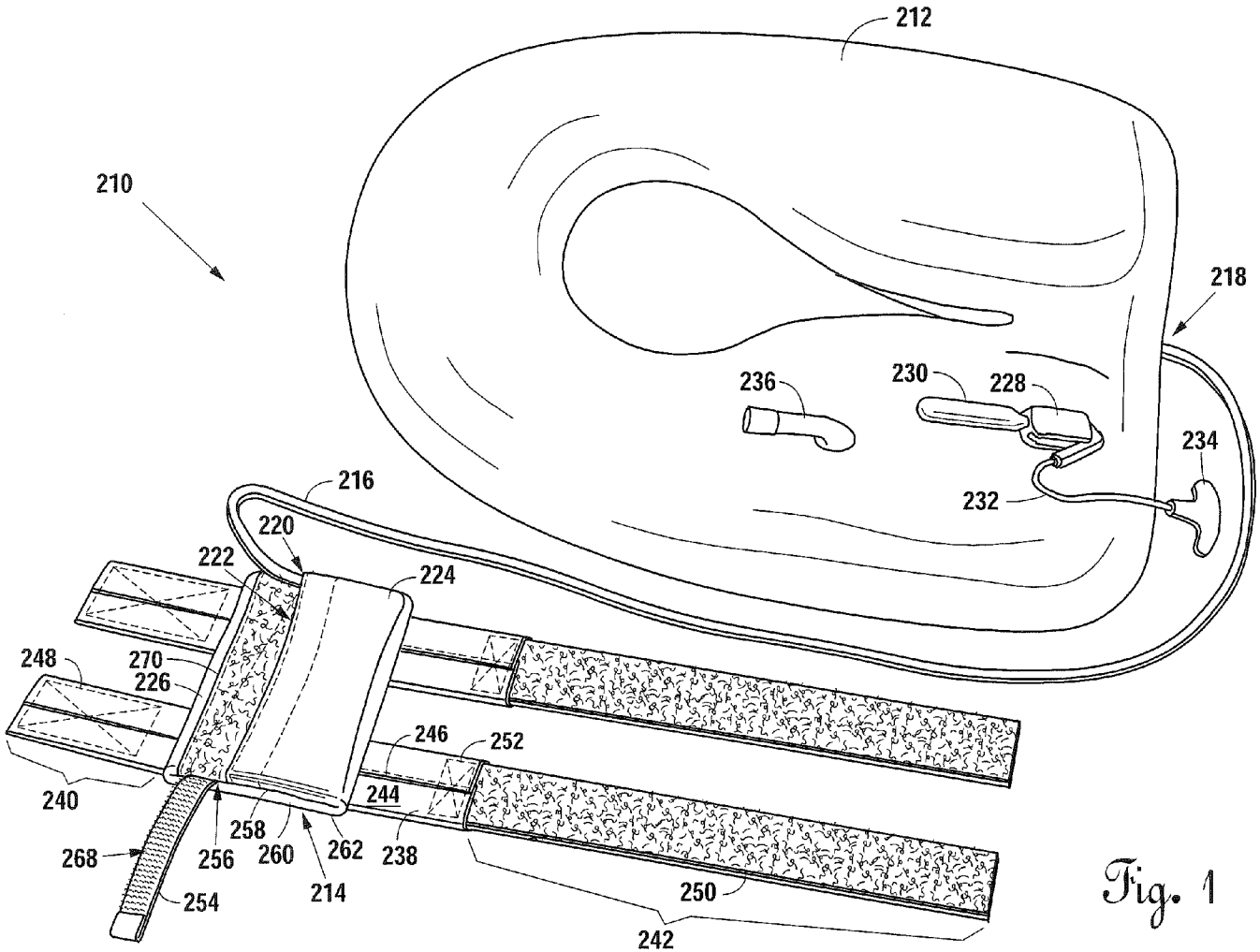
FIG. 1 is a top perspective view of an embodiment of the PFD sleeve with a PFD deployed and with a retaining strip extending from a compartment of the PFD sleeve.

A personal floatation device (PFD) sleeve 210 is shown in FIG. 1. The sleeve 210 has a PFD 212 in the form of a life jacket deployed from a compartment 214 on the sleeve 210. The PFD 212 is attached to the compartment 214 via a tether 216 with a first end 218 attached to the PFD 212 and a second end 220 attached to the compartment 214. Preferably, the tether 216 is made from marine grade nylon which resists ultraviolet degradation and rot and is sewn or otherwise affixed within the compartment 214 and sewn or otherwise affixed to the PFD 212. The tether 216, however, could be made from any number of materials and attached to the compartment 214 and the PFD 212 in a number of ways. The tether 216 extends from within the compartment 214 through an opening 222 between a first top wall 224 and a second top wall 226.

The PFD 212 has a compressed gas cartridge releasing mechanism 228 on it. The compressed gas cartridge releasing mechanism 228 is well-known in the art. It has a compressed gas cartridge 230 which contains a gas (not shown) such as carbon dioxide ($CO_2$). The gas cartridge 230 is threaded into the gas cartridge releasing mechanism 228. A cord 232 is operatively coupled to the gas cartridge releasing mechanism 228 so that the mechanism 228 punctures the compressed gas cartridge 230 when the cord 232 is pulled. The cord 232 may have a handle 234 attached at one end for facilitating pulling. As an example, U.S. Pat. No. 3,754,731 describes one such compressed gas cartridge releasing mechanism 228 known in the art.

When the cord 232 is pulled and the compressed gas cartridge 230 is punctured, the compressed gas (not shown) exits the cartridge 230 and the PFD 212 is rapidly inflated. Upon inflation, the PFD 212 expands to a volume larger than the compartment 214 causing it to exit the compartment through the opening 222. Additionally, the PFD 212 may have a manual inflation tube 236 for maintaining inflation of the PFD 212 after it has been deployed, or, for manually inflating the PFD 212 after pulling it from the compartment 214 through the opening 222. In this regard, the manual inflation tube 236 has a check valve (not shown) for allowing air flow into the PFD 212 but preventing air flow out of the PFD 212. Once inflated, the PFD 212 may be deflated by pushing against the check valve (not shown).

The compartment 214 may be attached to one or more strips 238. When present, each of the strips 238 connects a first connection panel 240 and a second connection panel 242 to opposing sides of the compartment 214. In the embodiment shown, the first connection panel 240 is integral with the strips 238 while the second connection panel 242 is separate from the strips 238. In this regard, each of the strips 238 has a first piece of material 244 with edges folded toward each other and a longitudinal seam 246 is sewn down the middle. The first connection panel 240 is sewn into the material 244 of the strips 238 on one side of the compartment 214 using a box stitch 248 or is otherwise affixed to the material 244. In contrast, the second connection panel 242 is a second piece of material 250 sewn (or otherwise affixed) to the first piece of material 244 using a box stitch 252, with the second connection panel 242 being connected on an opposing side of the compartment 214 from the first connection panel 240.

Preferably, the first piece of material 244 is a flexible nylon fabric while the second piece of material 250 is an elastic material such as Neoprene which has been laminated with unbroken loop fabric. It should be noted, however, that the first and second connection panels 240, 242 may be made from the same type of material, may both be integral with the strips 238, or may be directly connected to the compartment 214 without the strips 238. Further, it should be noted that the strips 238 may be configured differently in alternative embodiments. For example, the first piece of material 244 may not be folded or the seam 246 may be in an alternative position or not present at all.

A retaining strip 254 extends from the compartment 214 in FIG. 1. The retaining strip 254 has a first attachment point 256 to the compartment 214. The first attachment point 256 is shown along a seam 258 at an end wall 260 of the compartment 214. The end wall 260 and the seam 258 are formed by joining the first and second top walls 224, 226 of the compartment 214 with a bottom wall 262 of the compartment 214. It should be noted, however, that the first attachment point 256 of the retaining strip 254 may be located elsewhere on the compartment 214 and the retaining strip 254 may be attached in some other manner such as, for example, if it were riveted or snap fastened to the compartment 214 at the first attachment point 256.

Figure 2:
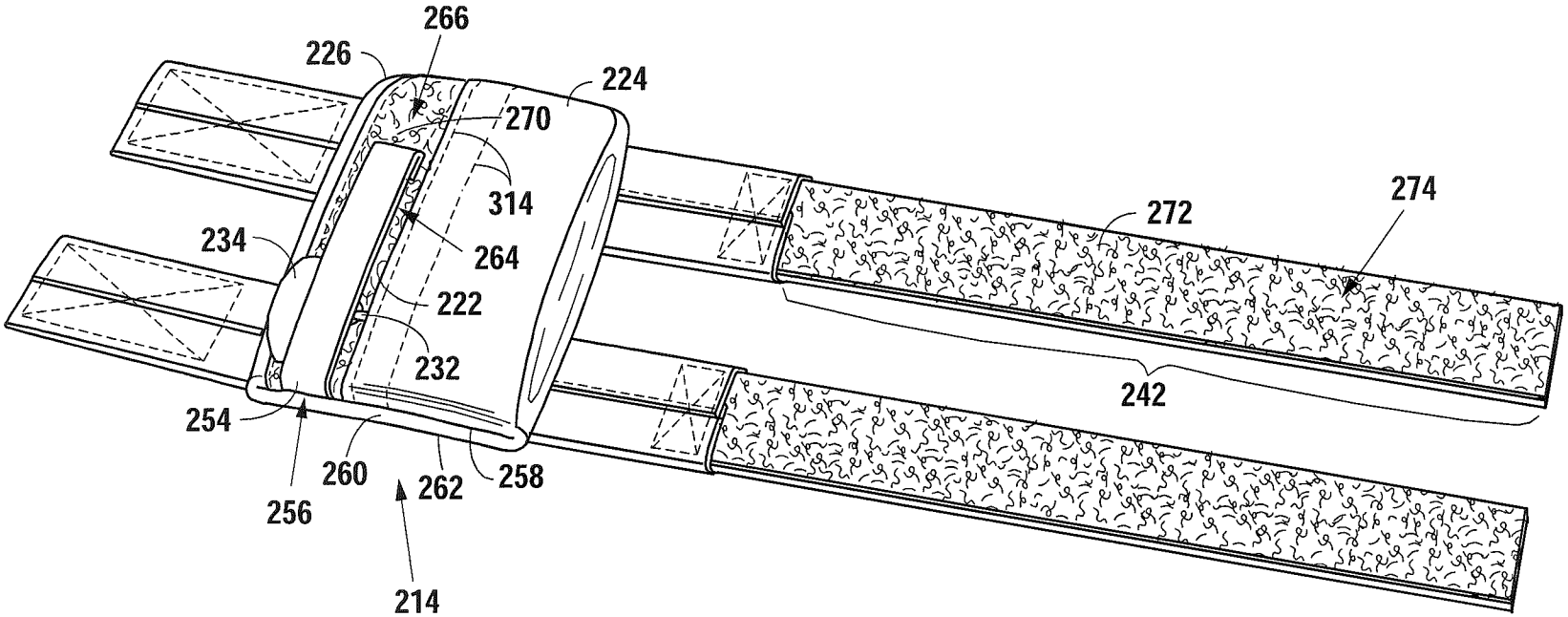
FIG. 2 is a top perspective view of the PFD sleeve shown in FIG. 1 with the PFD inserted within the compartment prior to deployment.

Apart from the first attachment point 256, the preferred retaining strip 254 has a second attachment point 264 where a fastening means for detachably connecting the retaining strip 254 to the compartment 214, as shown in FIG. 2. The second attachment point 264 is preferably on an outer surface 266 of the second top wall 224 of the compartment 214, but, could be located elsewhere on the compartment 214 depending on the length of the retaining strip 254 and its configuration on the compartment 214. Preferably, the fastening means is a hook-and-loop fastener such as, for example, a Velcro® hook-and-loop fastener, and a first component 268 of the hook-and loop fastener is sewn or otherwise affixed to the retaining strip 254 while a second component 270 of the hook-and-loop fastener is sewn or otherwise affixed to the outer surface 266 of the second top wall 226. The first component 268 may be the "hooks" of the fastener while the second component 270 may be the "loops" of the fastener, or vice versa. It should be noted, however, that other fastening means may be used such as, for example, snap fasteners, buttons, buckles, or the like. Additionally, the retaining strip 254 may be "permanently" rather than detachably connected to the compartment 214 at its second attachment point 264.

The PFD 212 is within the compartment 214 in FIG. 2 and the cord 232 extends from the compressed gas cartridge releasing mechanism 228 within the compartment 214 through the opening 222 between the first and second top walls 224, 226. The retaining strip 254 extends from its first attachment point 256, over the outer surface 266 of the second top wall 226 and over the handle 234 on the cord 232 to its second attachment point 264. The handle 234 of the cord 232, is positioned between the retaining strip 254 and the outer surface 266 of the second top wall 226, securing the handle 234 and the cord 232 to the compartment 214. The handle 234 is shown in contact with the second component 270 on the outer surface 266, however, in alternative embodiments it may not be. For example, the handle 234 may directly contact the outer surface 266 of the second top wall 226 if the second component 270 were smaller than that shown. Further, the retaining strip 254 may secure the handle 234 to the compartment 214 in some other manner, such as, for example, if its first attachment point 256 were on the first top wall 224 and its second attachment point 264 were on the second top wall 226 or even on the bottom wall 262 of the compartment 214. Moreover, the handle 234 may not be present and the retaining strip 254 may extend over the cord 232.

Figure 3:
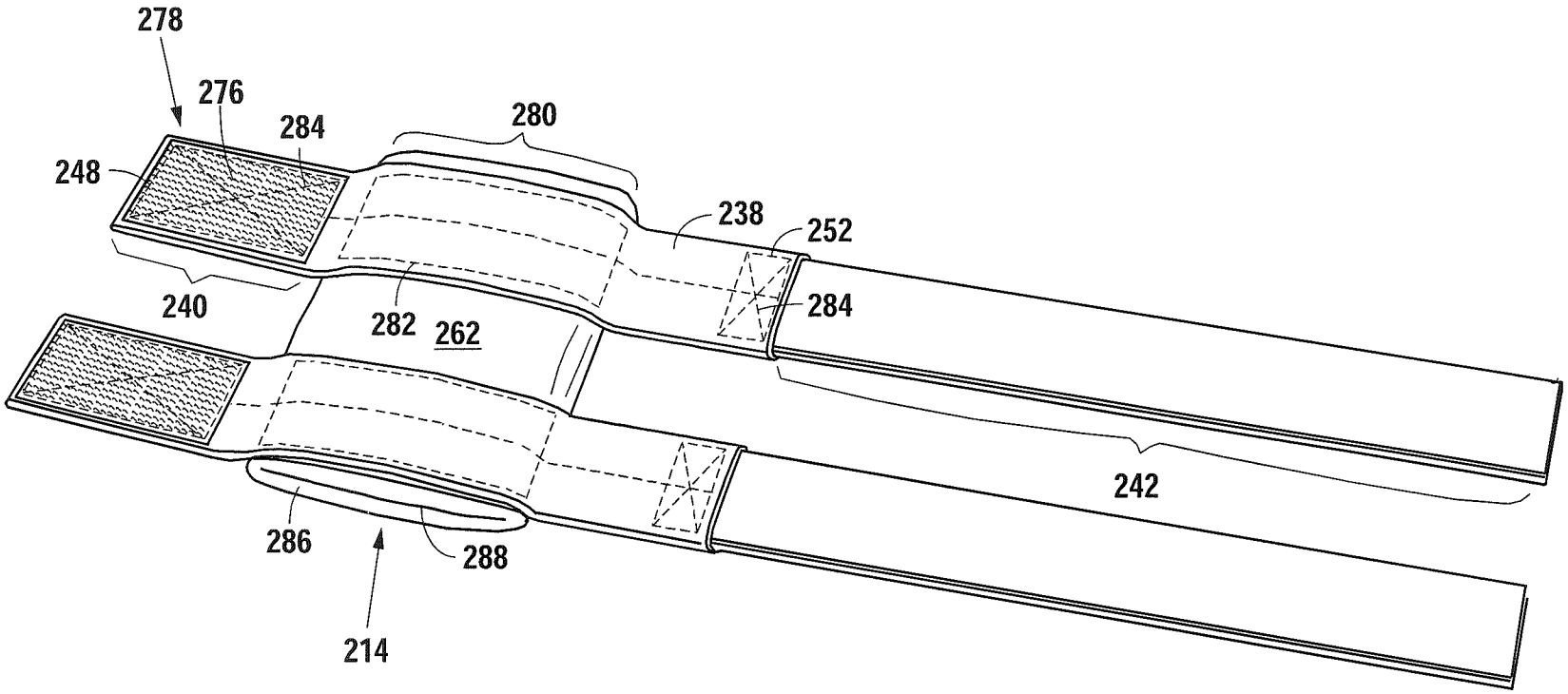
FIG. 3 is a bottom perspective view of the PFD sleeve shown in FIG. 2.

A fastening means detachably connects the first and second connection panels 240, 242 so that the PFD sleeve 210 may be installed on a user's appendage. Preferably, the fastening means is a hook-and-loop fastener such as, for example, a Velcro® hook-and-loop fastener, and a first component 272 of the hook-and loop fastener is sewn or otherwise affixed to an external surface 274 of the second connection panel 242 as shown in FIG. 2 while a second component 276 of the hook-and-loop fastener is sewn or otherwise affixed to an internal surface 278 of the first connection panel 240 as shown in FIG. 3. The first component 272 may be the "loops" of the fastener while the second component 276 may be the "hooks" of the fastener, or vice versa. It should be noted, however, that other fastening means may be used to detachably connect the first and second connection panels 240, 242 such as, for example, snap fasteners, buttons, buckles, or the like.

The attachment of the compartment 214 to the strips 238 is shown in FIG. 3. Each of the strips 238 has a region 280 where the compartment 214 is attached. Preferably, the compartment 214 is sewn to the region 280 using a box stitch 282 or some other stitch pattern. Alternatively, the compartment 214 may be affixed or attached to the region 280 in some other manner. Also shown are the box stitches 248, 252 affixing, respectively, the first and second connection panels 240, 242 to the strips 238. These box stitches 248, 252 each have diagonal stitching 284 for reinforcement.

Figure 4:
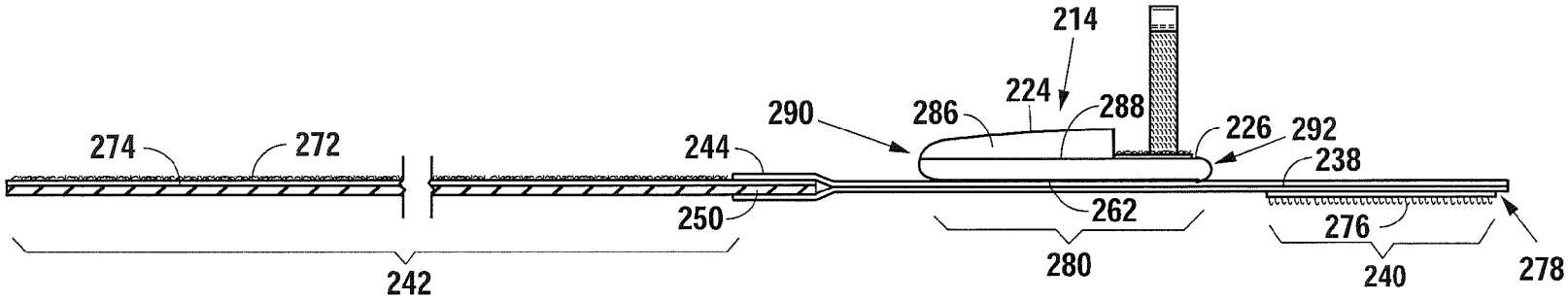
FIG. 4 is a side view of the PFD sleeve shown in FIG. 1 wherein an internal surface of the PFD sleeve is on the bottom and an external surface of the PFD sleeve is on the top and with the PFD and tether omitted for illustration purposes.

In FIG. 4, the compartment 214 is shown attached to the region 280 on one of the strips 238 from a side view. The first piece of material 244 of the strips 238 extends around the second piece of material 250 of the second connection panel 242 and the box stitch 252 affixes the two materials 244, 250 to each other. The first component 272 of the preferred fastening means is shown along the external surface 274 of the second connection panel 242 while the second component 276 is shown along the internal surface 278 of the first connection panel 240.

An end wall 286 of the compartment 214 is also shown in FIG. 4. End wall 286 and end wall 260 (see, e.g., FIG. 1) are on opposing sides of the compartment 214. Like end wall 260, end wall 286 in FIG. 4 is formed by joining the first and second top walls 224, 226 with the bottom wall 262 at a seam 288. A first side wall 290 and a second side wall 292 are also on opposing sides of the compartment 214.

Figure 5:
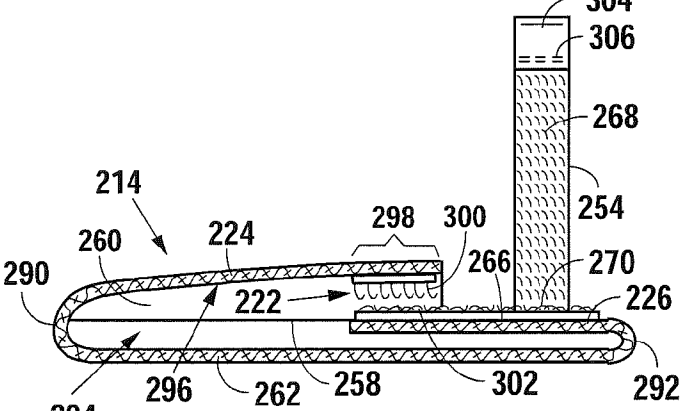
FIG. 5 is a cross section taken along the inside of an end wall of the compartment and shows an interior of the compartment with the PFD and tether omitted for illustration purposes.

In FIG. 5, a cross section of the compartment 214 is taken inside the end wall 286 to illustrate an interior 294 of the compartment 214. Looking through the interior 294, the end wall 260 and the seam 258 on the opposing side of the compartment 214 are seen. The first top wall 224, the second top wall 226, and the bottom wall 262 help define the interior 294 of the compartment 214. The first side wall 290 is formed by folding the first top wall 224 toward the bottom wall 262 and the second side wall 292 is formed by folding the second top wall 226 toward the bottom wall 262. The first top wall 224 has an interior surface 296 with an overlapping portion 298 extending over the outer surface 266 of the second top wall 226.

The preferred opening 222 is between the overlapping portion 298 of the first top wall 224 and the second top wall 226. A fastening means for detachably connecting first top wall 224 to the second top wall 226 may be present to close the opening 222. Preferably, the fastening means is a hook-and-loop fastener such as, for example, a Velcro® hook-and-loop fastener, and a first component 300 of the hook-and loop fastener is sewn or otherwise affixed to the interior surface 296 of the first top wall 224 along the overlapping portion 298 while a second component 302 of the hook-and-loop fastener is sewn or otherwise affixed to the outer surface 266 of the second top wall 226. The first component 300 may be the "hooks" of the fastener while the second component 302 may be the "loops" of the fastener, or vice versa. It should be noted, however, that other fastening means may be used such as, for example, snap fasteners, buttons, buckles, or the like.

Also shown in FIG. 5 is the retaining strip 254 with the first component 268 above the second component 270 of the hook-and-loop fastener. The retaining strip 254 has a tab 304 at its end where the first component 268 is not present. The preferred tab 304 is formed by folding a portion of the retaining strip 254 in on itself and placing stitching 306 across the retaining strip 254, but, tab 304 may be formed in some other manner Additionally, it should be noted that the second component 270 for the retaining strip 254 and the second component 302 for closing the opening 222 between the first and second top walls 224, 226 may be configured the same—i.e., both as a "hooked" surface or both as a "looped" surface—and may be formed from a single integral piece, as shown.

Figure 6:
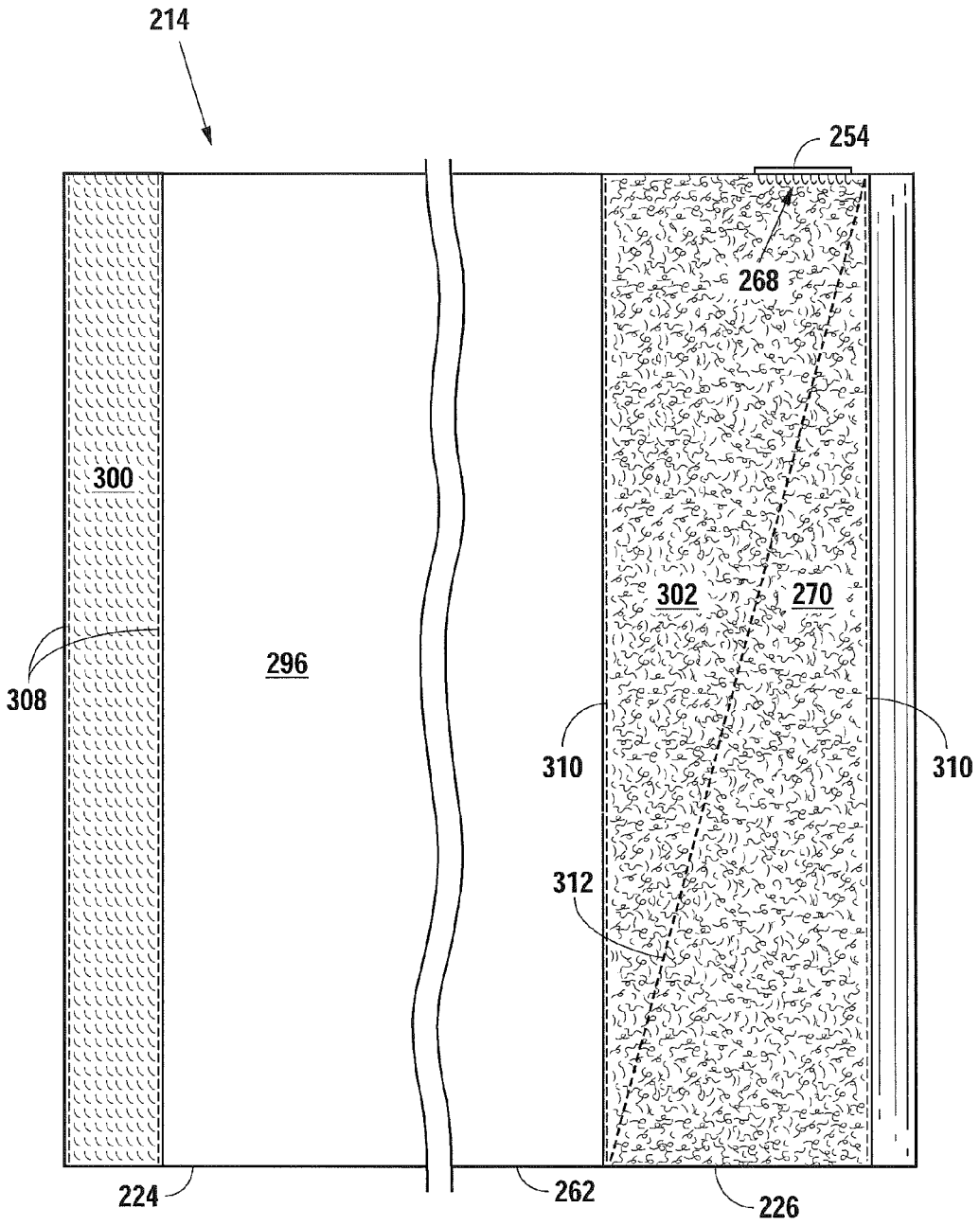
FIG. 6 is a top view of the compartment with a first top wall of the compartment shown unfolded from its position in FIG. 5.

In FIG. 6, the first top wall 224 has been unfolded in a direction away from the bottom wall 262 to illustrate the first component 300 on its interior surface 296. In contrast, the second top wall 226 remains folded and the second component 302 on the outer surface 266 of the second top wall 226 is visible. The first component 300 is sewn to the interior surface 296 of the first top wall 224 with stitching 308 along its sides. Stitching 310 along the sides of the second components 270, 302 and diagonal stitching 312 across the second components 270, 302 sews these components to the second top wall 226 when the second components 270, 302 are an integral piece. Alternative stitching may be present, for example, if the two second components 270, 302 were separate pieces.

As shown, the first and second components 300, 302 are shaped as a rectangle, with the surface area of the second component 302 being larger than the surface area of the first component 300. The larger surface area of the second component 302 with respect to the first component 300 allows the first top wall 224 to be pulled taut over the PDF 212 even when the compartment 214 is wet and stretches. Preferably, the surface area of the second component 302 is at least one-and-one-half times larger than the surface area of the first component 300.

As noted, second component 302 is preferably a single integral piece with second component 270. In this regard, the first component 300 of the first top wall 224 shares the single integral piece with the first component 268 of the retaining strip 254 if the retaining strip 254 is present. When the first component 268 of the retaining strip 254 is connected to the single integral piece, the surface area of the single integral piece which remains available for the first component 300 is still larger than the surface area of the first component 300 of the first top wall 224. In FIG. 2, for example, stitching 314 along the first top wall 224 is along the boundary of the surface area for the first component 300 and surface area of the single integral piece between the first top wall 224 and the retaining strip 254 remains available.

Figure 7:
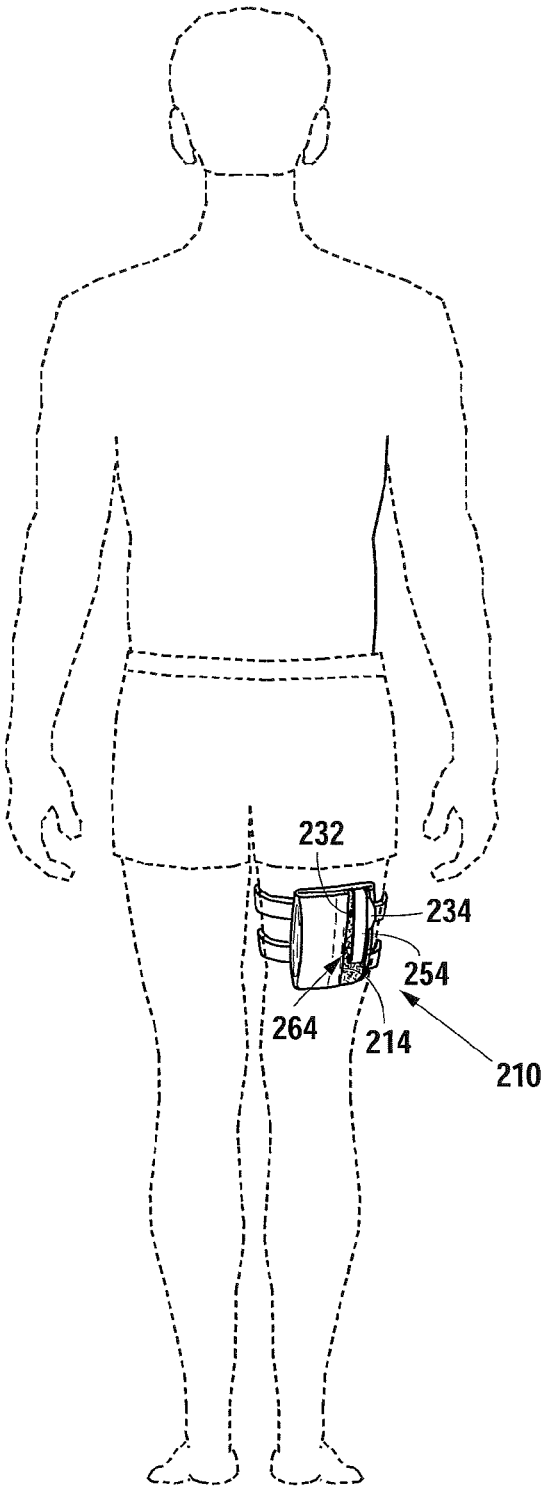
FIG. 7 is a perspective view of the PFD sleeve attached to a user's right thigh.
Figure 8:
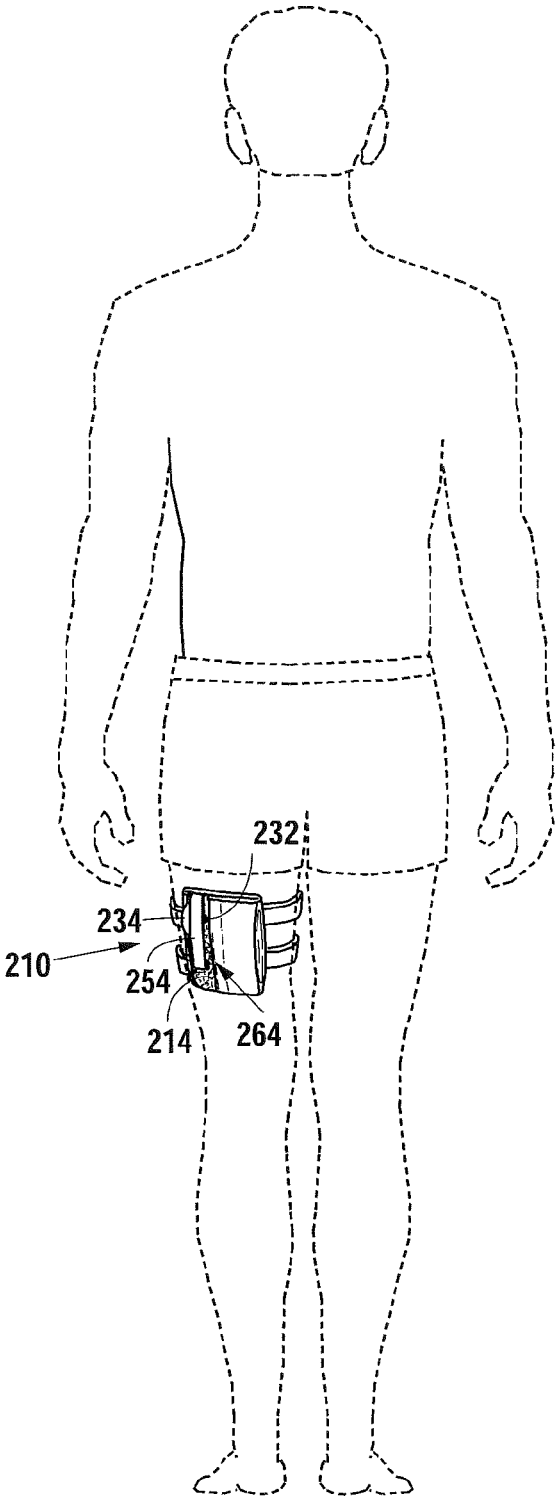
FIG. 8 is a perspective view of the PFD sleeve attached to a user's left thigh.

FIG. 7 shows the PFD sleeve 210 positioned in its preferred placement on a user's leg for a right-handed user while FIG. 8 shows the preferred placement for a left-handed user. The retaining strip 254 extends over the handle 234 attached to the cord 232, thereby securing these items against the PFD sleeve 210 and preventing unwanted deployment of the PFD 212. When the user encounters an emergency situation and needs to deploy the PFD 212, the user disconnects the retaining strip 254 from its second attachment point 264 to the compartment 214 and pulls the handle 234 to inflate and deploy the PFD 212 as previously described. Alternatively, the user will remove handle 234 from between the retaining strip 254 and the outer surface 266 prior to pulling the handle 234 to deploy the PFD 212 if the retaining strip 254 were not detachably connected to the compartment 214 at its second attachment point 264.

Although the present invention has been described with reference to specific embodiments, this description is not meant to be construed in a limiting sense. Various modifications of the disclosed embodiments, as well as alternative embodiments of the invention will become apparent to persons skilled in the art upon the reference to the above description of the invention. It is therefore, contemplated that the appended claims will cover such modifications that fall within the scope of the invention.

I claim:

1. A personal floatation device (PFD) sleeve which is worn on a swimmer's appendage comprising:

a compartment having an interior, said interior being at least partially defined by a first top wall, a second top wall, and a bottom wall, said second top wall having an outer surface;

an opening into the interior of the compartment between the first top wall and the second top wall;

an inflatable PFD having a compressed gas cartridge releasing mechanism, said PFD being insertable through the opening into the interior of the compartment;

a cord operatively coupled to and extending from the compressed gas cartridge releasing mechanism;

a tether having a first end attached to the PFD and a second end attached to the compartment;

at least one first connection panel and at least one second connection panel connected to opposing sides of the compartment; and, a fastening means for detachably connecting the first connection panel to the second connection panel.

2. The PFD sleeve of claim 1 further comprising at least one strip connecting said first connection panel and said second connection panel to said compartment, said at least one strip having a region between said first connection panel and said second connection panel, and, wherein said compartment is attached to said strip at said region.

3. The PFD sleeve of claim 1 further comprising a retaining strip having first and second attachment points to the compartment, said retaining strip being configured to secure the cord to the compartment between said first and second attachment points.

4. The PFD sleeve of claim 3 further comprising a handle attached to said cord, and, wherein said retaining strip extends over the outer surface of the second top wall and over said handle of said cord between the first and second attachment points of the retaining strip.

5. The PFD sleeve of claim 4 further comprising a fastening means for detachably connecting the retaining strip to the compartment at said second attachment point.

6. The PFD sleeve of claim 5 wherein said fastening means is a hoop-and-loop fastener having a first component affixed to the retaining strip and a second component affixed to the outer surface of the second top wall, said first and second components being configured to detachably connect with each other.

7. The PFD sleeve of claim 3 wherein the first attachment point of said retaining strip is along a seam between the second top wall and the bottom wall.

8. A personal floatation device (PFD) sleeve which is worn on a swimmer's appendage comprising:

a compartment having an interior, said interior being at least partially defined by a first top wall, a second top wall, and a bottom wall, said first top wall having an interior surface and said second top wall having an outer surface, said interior surface of said first top wall having an overlapping portion extending at least partially over the outer surface of said second top wall;

an opening into the interior of the compartment between the first top wall and the second top wall;

a hook-and-loop fastener between the first top wall and the second top wall, said hook-and-loop fastener being configured to at least partially close said opening and comprising:

a first component affixed to the interior surface of the first top wall along the overlapping portion, said first component having a surface area;

a second component affixed to the outer surface of the second top wall, said second component having a surface area; and, wherein said first and second components are configured to detachably connect with each other and said surface area of said second component is larger than the surface area of the first component;

an inflatable PFD having a compressed gas cartridge releasing mechanism, said PFD being insertable through the opening into the interior of the compartment;

a cord operatively coupled to and extending from the compressed gas cartridge releasing mechanism;

a tether having a first end attached to the PFD and a second end attached to the compartment;

at least one first connection panel and at least one second connection panel connected to opposing sides of the compartment; and, a fastening means for detachably connecting the first connection panel to the second connection panel.

9. The PFD sleeve of claim 8 further comprising at least one strip connecting said first connection panel and said second connection panel to said compartment, said at least one strip having a region between said first connection panel and said second connection panel, and, wherein said compartment is attached to said strip at said region.

10. The PFD sleeve of claim 8 further comprising a retaining strip having first and second attachment points to the compartment, said retaining strip being configured to secure the cord to the compartment between said first and second attachment points.

11. The PFD sleeve of claim 10 further comprising a handle attached to said cord, and, wherein said retaining strip extends over the outer surface of the second top wall and over said handle of said cord between the first and second attachment points of the retaining strip.

12. The PFD sleeve of claim 11 further comprising a fastening means for detachably connecting the retaining strip to the compartment at said second attachment point.

13. The PFD sleeve of claim 12 wherein said fastening means is a hoop-and-loop fastener having a first component affixed to the retaining strip and a second component affixed to the outer surface of the second top wall, said first and second components being configured to detachably connect with each other.

14. The PFD sleeve of claim 13 wherein the second component of the fastening means between the first and second top walls is configured the same as the second component of the fastening means between the retaining strip and the outer surface of the second top wall.

15. The PFD sleeve of claim 14 wherein the second component of the fastening mean between the first and second top walls and the second component of the fastening means between the retaining strip and the outer surface of the second top wall are a single integral piece.

16. The PFD sleeve of claim 10 wherein the first attachment point of said retaining strip is along a seam between the second top wall and the bottom wall.

* * * * *